United States Patent [19]

Daverport, Jr.

[11] 4,292,687

[45] Oct. 6, 1981

[54] PROTECTIVE SHOULDER PAD CONSTRUCTION

[75] Inventor: Stanley Daverport, Jr., Knoxville, Tenn.

[73] Assignee: The Kendall Company, Bostom, Mass.

[21] Appl. No.: 116,071

[22] Filed: Jan. 28, 1980

[51] Int. Cl.[3] ..... A41D 13/00

[52] U.S. Cl. ..... 2/2

[58] Field of Search ..... 2/2, 44, 45, 310, 311, 2/312, 92

[56] References Cited

U.S. PATENT DOCUMENTS

| | | | |
|---|---|---|---|
| Re. 17,772 | 8/1930 | Glass | 2/44 X |
| 1,136,307 | 4/1915 | Bourdon | 2/2 |
| 1,270,031 | 6/1918 | Jackson | 2/2 |
| 2,688,752 | 9/1954 | Sbarra et al. | 2/310 X |
| 3,087,163 | 4/1963 | Kelly | 2/2 |
| 3,134,106 | 5/1964 | Shaffer et al. | 2/2 |
| 3,528,106 | 9/1970 | Austin | 2/2 |
| 3,740,762 | 6/1973 | Trueloue | 2/2 |
| 3,740,763 | 6/1973 | Mitchell | 2/2 |

FOREIGN PATENT DOCUMENTS

| | | | |
|---|---|---|---|
| 548990 | 1/1923 | France | 2/310 |

*Primary Examiner*—Louis Rimrodt

*Attorney, Agent, or Firm*—Edward J. Scahill, Jr.

[57] ABSTRACT

A protective shoulder pad having novel V-shaped strap connections between the front and back panels of a shoulder pad. A single V-shaped strap can be crossed over on itself at the back panel and secured thereto at a single common point. The free ends of the V-shaped straps then come forward to the front panel and are secured thereto at two distinctly positioned points. The unique attachment means used herewith is economical, easy to use and produces a more comfortable and secure means of holding shoulder pads to the body of an athlete using same.

6 Claims, 5 Drawing Figures

PROTECTIVE SHOULDER PAD CONSTRUCTION

BACKGROUND OF THE INVENTION

The present invention relates to protective shoulder pads, and more particularly to a V-shaped cross-over strap construction for use with such pads.

Shoulder pads have been used for many years by a variety of athletes; however, the past thirty or forty years have shown that they are of most use to football players. Today's athlete, generally, is bigger and stronger than his counterpart in the past. Furthermore, today's game has required speed and agility, even in offensive and defensive linemen, which are not thought possible in the past. To this end, it is of paramount importance that the athlete's protective equipment be as streamlined as possible, while at the same time is of such construction as to give him the utmost of protection and the highest degree of comfort as is possible.

For some years, shoulder pads were placed on the shoulder of the athlete and tied with lacings, or the like, at the front and/or back panels and elastic straps were used on or near the lower portions of the panels thereof to connect the front and back panels in an attempt to secure the pads to the athlete. As time went on, more attention was given to making the elastic strap connectors adjustable so that the pads could be held onto the athlete in a more secure fashion. In recent years, some models of shoulder pads have introduced an additional strapping means for the purpose of securely holding the pads to the athlete, and also to prevent the pads from having any upward mobility causing discomfort to the athlete wearing them.

U.S. Pat. No. 3,087,163 shows a single strap connector in the front portion of the pads that goes around toward the back where a hanging double connecting strap secures the back portion of the pads to the back portion of the connecting strap. However, while this construction may securely hold the pads in place, it does have the disadvantage, because of its elasticity and positioning of all three straps, of creeping up on the athlete during the performance of his athletic duties. U.S. Pat. No. 3,134,106 shows a somewhat similar construction wherein the two connecting straps therein are attached to the pants of the athlete. This prevents the pads from creeping up on the athlete but has the disadvantage of discomfort and the expense of completely redesigning the pad construction and pant construction. U.S. Pat. No. 3,740,763 shows still another construction wherein the straps are used in a criss-crossing manner going from front to back that is difficult to adjust, attach and use. Each of the above-described strapping constructions all use more than two connecting straps.

Accordingly, a principal feature of the present invention is the provision of a strap construction for securing shoulder pads to the body of the athlete that is comfortable to wear and easy to use and adjust.

Another object of this invention is to provide such a strap construction that has the above-referenced advantages but is easy to manufacture as well as being economical to do so.

Still another object of the instant invention is to provide shoulder pads that will not creep up on the athlete during the performance of his skills on the field.

SUMMARY OF THE INVENTION

Protective shoulder pads comprising front panels and back panels from which additional protective padding attaches has a unique, V-shaped, single strap connector running from each back panel to its opposite front panel portion. The front panel portions of the pad have slotted openings therein, spaced apart from each other, while the back panel has a single secure fastening means. A connecting strap slidably passes through an adjustable buckle means attached to a looped, riveted fastening means, or the like, on the back panel thereof in such a manner that opposite free ends of the connecting strap, each free and having slidably, adjustable buckles thereon having a keyed protruding portion thereon, will advantageously fit into the slotted openings on the front panels. The thusly secured pads have a two-way torque exerted on the front of the shoulder pads from a single fastening point in the back thereby producing a dual front securement of the pads to the body of the athlete.

DESCRIPTION OF THE PREFERRED EMBODIMENTS

Figure 1:
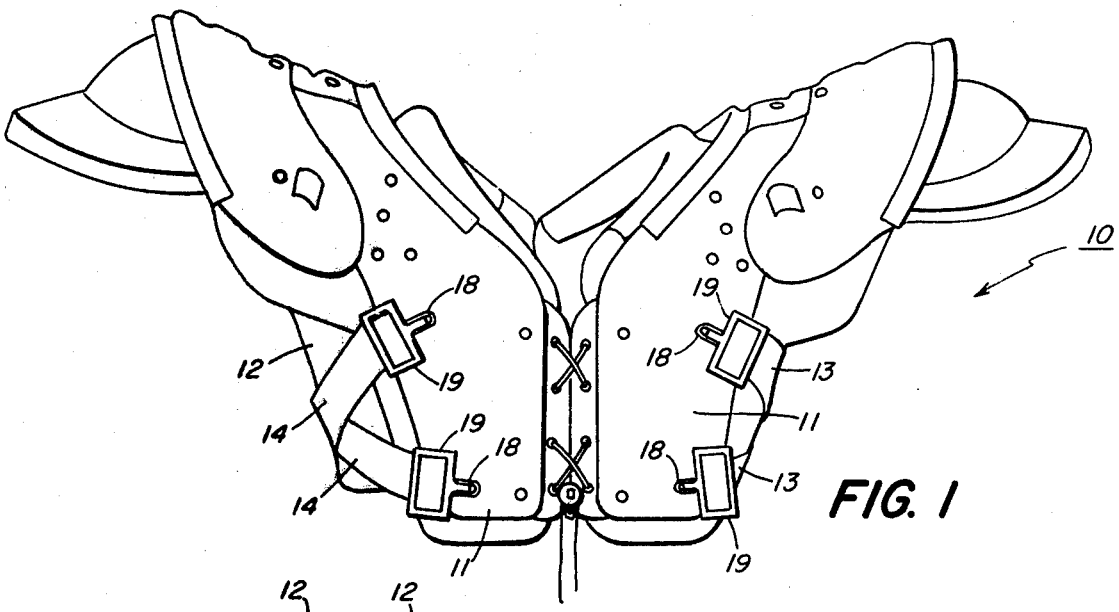
FIG. 1 is a perspective view of the shoulder pads of this invention.
Figure 2:
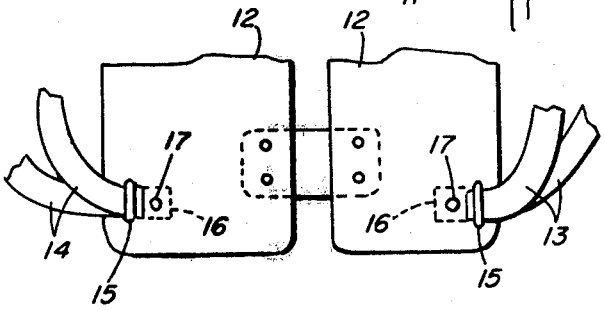
FIG. 2 is a partial perspective view of the back panels of the shoulder pads showing the single attachment means used therein and as described in this invention.
Figure 3:
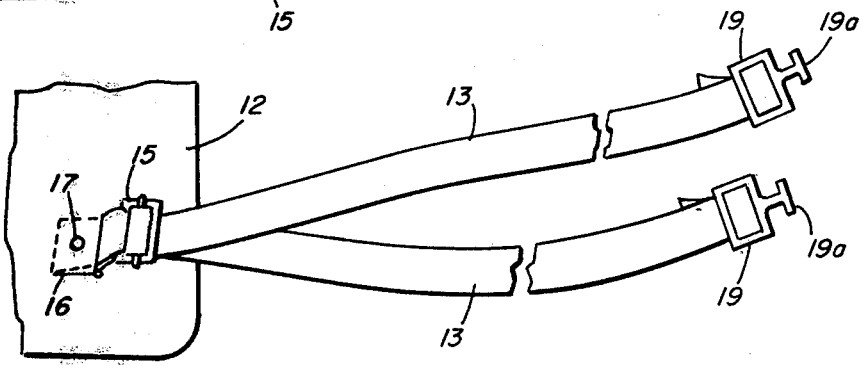
FIG. 3 is a partial perspective close-up of the connecting strap of this invention and its further use and attachment on the back panel of the protective pad.

Referring to FIGS. 1–3 in the drawings, there is shown, in FIG. 1, a protective shoulder pad construction 10 having a pair of front panels 11 and a pair of back panels 12, which when secured together by lacings or the like forms a unitary structure as shown. The athlete puts the pads on over his shoulders in the usual manner and initially secures same by means of conventional laces. In an attempt to secure the pads of his body for comfort and to insure the pads will not float or creep up during use, V-shaped connector straps 13 and 14 are secured to the front panels 11 by inserting a keyed portion 19A of the buckle 19 shown in FIG. 3 into the slotted openings 18 on the front panels 11 which are specifically placed. One slotted opening 18 is located on a lower third portion of panels 11, more specifically, in the lower right and left corners of the front panel 11, while two other slotted openings 18 are positioned above that area in a middle third portion of front panels 11, approximately midway between the top and bottom of the front panels 11. Of course, the buckles 19 can be releasably and slidably adjustable for ease of use and comfort of the wearer.

The straps 13 and 14 are securely held to the back panel by means of a single common attachment point 17 on each of the back panels 12 of the shoulder pads 10. FIGS. 2 and 3 show such a fastening or attachment point wherein a rivet 17, or the like, holds a material looped thereon. A buckle-type device 15 is attached to the loop on one side and to the straps 13 and 14 on the other side thereof in a manner such as shown in FIG. 3. In this manner, the straps 13 and 14 can be adjusted at buckle 15 and/or at buckles 19.

Figure 5:
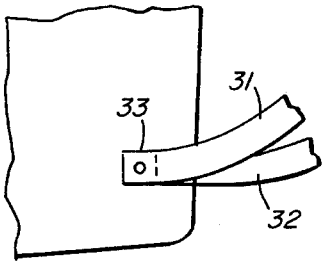
FIG. 5 is a partial perspective close-up of another embodiment of the connecting strap of this invention.

Alternatively, FIG. 5 shows another connector strap construction. In lieu of using a single strap crossed over on itself, a set of two shorter straps 31 and 32 can be joined together at a common end thereof, such as 33, so as to have two free ends available for attachment to the front panels of the pads. This embodiment of the V-shaped straps can be secured to the back panel of the pads at the common end by any conventional means, such as a rivet; a snap clasp; hook and loop fabric fasteners; or the like.

While the preferred embodiments show the free ends of the V-shaped straps with keyed attachment portions on buckles releasably engageable with slotted openings on the front panels of the pads, different attachment means for securing the free ends of the straps to the front panels could be used. For example, strips of an open looped fabric material can be securely positioned on the front panels in place of, but in the same position as, the slotted openings, while strips of hooked fabric material capable of releasably engaging the looped fabric material can be secured to the free ends of said V-shaped straps. The hooked and looped fabric strips should be of sufficient length so as to permit adjustability. A commonly known hooked and looped material is a Velcro fastener.

The shoulder pads described herein may have any number of additional padding attached thereto such as shown on the drawings. These pads can include shoulder joint build-ups, neck rolls and padding of, for example, closedcell vinyl rubber on the front and back panels for protection and comfort. This invention may be used on any type of shoulder pad construction having front and back panels similar to those shown in the drawings.

The pads made herein can advantageously be made with much ease of manufacture, are economical in that only one attachment means is required on the back panel and only a strap bar side is used therewith.

Figure 4:
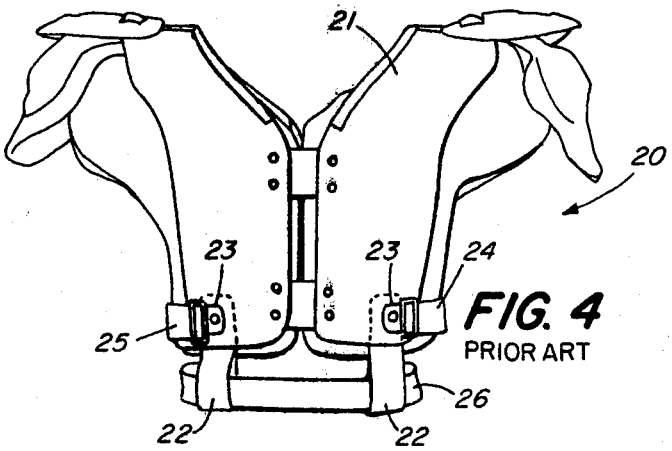
FIG. 4 PRIOR ART
FIG. 4 is a perspective view of a prior art shoulder pad, showing the back panels thereof.

FIG. 4 shows a prior art pair of shoulder pads 20, wherein back panel 31 is depicted to show the attachment means used therewith. A single strap 24 on one side and 25 on the other side connects opposite portions of the front and back panels. The straps 24 and 25 are connected to the back panel by means of rivets 23, or the like, which also serves to hold drop hangers 22 shown thereon. An additional strap 26, which runs through the loops of the drop hangers 22, connects at one end to a slotted opening on the front panel on one side, runs around the upper waist of the wearer so that the other end of strap 26 is connected then to a slotted opening on the opposite portion of the front panel. This shoulder pad construction looks similar to the pads described herein while looking at the front thereof, but the back panel, strapping and attachment, shown in FIG. 4, is dramatically different from the strapping and attachment described in this invention.

The positioning of the slotted openings on the middle and lower third portions of front panels of this shoulder pad construction produces a downward torque by means of straps 13 and 14 coming down at approximately a 60° angle to the other free end of straps 13 and 14 coming straight out from the back panel attachment onto panel 12. This advantageous torque action, simultaneously pulls the pads down onto the wearer's body and against the wearer's body.

The prior art pads shown in FIG. 4, tend to creep up on the athlete because of the flappy nature of the drop hangers 22. These drop hangers are generally made of a flexible fabric material. If the drop hangers 22 are too rigid they become a danger to the wearer since they stand alone in unprotected fashion and would be positioned to spear into the kidney region of the wearer's back with certain movements. Usually, these flexible fabric portions are impregnated with a vinyl or the like to have added strength and stability, but, of necessity, they must be flexible enough to permit adjustment and to prevent injury. As such, they are disadvantageously free to float or creep up the body of the wearer during his play in the field. Furthermore, such a construction is more difficult and expensive to manufacture and to use because of the additional materials required thereby.

Of course, we have described the preferred methods of fastening the connecting straps of this invention to the front and back panels. It is urged, however, that other fastening means are available to the industry and are covered by the scope of this invention.

What is claimed is:

1. In a protective shoulder pad having various protective padding attached to two at least semi-rigid front and back panel portions thereof releasably secured to each other, the improvement comprising each of said front panels having at least two attachment means disposed thereon, including a first attachment means on each said front panels disposed on a lower third portion of said panel and a second attachment means on each of said front panels disposed on a middle third portion thereof; a first V-shaped connector strap for connecting one front panel and one back panel from a single common point on said back panel, and a second V-shaped connector strap connecting said other front and back panel from a single common point on said other back panel; said first and second connector straps, each having two free ends and a common crossover point disposed approximately midway between same, said free ends having attachment means disposed near the free end thereof for releasably engaging said connector straps on said attachment means in said front panels, said common crossover point being attached to said back panels at said single common point.

2. The shoulder pads of claim 1 wherein said attachment means on said front panels are slotted openings, and said attachment means on said free ends of said connector straps are buckles having keyed portions thereon for releasably engaging said slotted openings on said front panels.

3. The shoulder pad of claim 1 wherein said attachment means on said front panels are a looped fabric material, and said attachment means on said free ends of said connector straps are hooked fabric material for releasably engaging said looped fabric on said front panels.

4. The shoulder pad of claim 1 wherein said first and second V-shaped connector straps each comprise a single strap crossed over itself through a buckle-type device.

5. The shoulder pad of claim 1 wherein said first and second V-shaped connector straps each comprise a set of two straps jointly connected at one end thereof leaving each of said two straps with a free end for attachment to said front panels.

6. In a protective shoulder pad having various protective padding attached to two at least semi-rigid front and back panel portions thereof releasably secured to each other, the improvement comprising each of said front panels having two slotted openings disposed thereon, including a first slotted opening disposed on a lower third portion of each of said front panels, and a second slotted opening disposed on a middle third portion of each of said front panels; a first and second V-shaped connector strap for connecting said front and back panels; said first and second V-shaped straps each being a single strap crossed over itself through a buckle-type device so as to have two free ends and a common crossover point disposed approximately midway between same, said free ends having buckles near the free ends thereof that have keyed portions thereon for releasably engaging said slotted openings on said front panels, and said common crossover point being attached at a single common point on said back panel.

* * * * *